US005894911A

United States Patent [19]

Bozorgzadeh et al.

[11] Patent Number: 5,894,911

[45] Date of Patent: Apr. 20, 1999

[54] CAR DOOR LOCKING SYSTEM

[75] Inventors: Ali Bozorgzadeh, Springfield, Mass.; Troy R. Chicoine, Granby, Conn.; Frank E. Dyer, Enfield, Conn.; John J. Faup, Simsbury, Conn.; Jesse R. Richter, West Hartford, Conn.; Frank P. Morrisino, East Longmeadow, Mass.; Wayne L. Virkler, Vernon, Conn.

[73] Assignee: Otis Elevator Company, Farmington, Conn.

[21] Appl. No.: 08/893,430

[22] Filed: Jul. 11, 1997

[51] Int. Cl.[6] ..... B66B 13/06

[52] U.S. Cl. ..... 187/335; 49/116

[58] Field of Search ..... 187/335, 334, 187/331, 314, 333; 49/116, 120

[56] References Cited

U.S. PATENT DOCUMENTS

| | | | |
|---|---|---|---|
| 4,529,065 | 7/1985 | Kraft | 187/335 |
| 5,386,886 | 2/1995 | Kubajashi et al. | 187/335 |
| 5,454,447 | 10/1995 | Kulak et al. | 187/331 |
| 5,655,627 | 8/1997 | Honne et al. | 187/335 |

FOREIGN PATENT DOCUMENTS

| | | |
|---|---|---|
| 0035979A1 | 9/1981 | European Pat. Off. . |
| 0130493A2 | 1/1985 | European Pat. Off. . |
| 2212548 | 7/1989 | United Kingdom . |
| WO 8001186A1 | 6/1980 | WIPO . |

OTHER PUBLICATIONS

U.K. Search Report dated Sep. 12, 1997; serial No. GB 9713687.3.

U.S. Patent Application Serial No. 08/672,680 filed Jun. 28, 1996 entitled "Car Door Lock"; Marc. F. Chevilliard, et al. (OT–2707).

*Primary Examiner*—Kenneth Noland

[57] ABSTRACT

Microprocessor-based car door locking system includes an electromechanical door lock for elevator car doors having a latch-type rotary solenoid to move a plunger into locked and unlocked positions. In the locked position, the plunger engages a bracket mounted on the elevator car door. The door lock also includes a controller that integrates the door lock into the elevator system and provides failure management for the door lock. The door lock of the present invention does not require power during either the locked or unlocked state.

14 Claims, 3 Drawing Sheets

CAR DOOR LOCKING SYSTEM

TECHNICAL FIELD

The present invention relates to elevator systems and, more particularly, to elevator car door locks therefor.

BACKGROUND OF THE INVENTION

It is typical for elevator systems to include a door lock mechanism on hoistway doors. The door lock mechanisms on the hoistway doors prevent the hoistway doors from being opened when the elevator car is not at a landing. A majority of the hoistway door locking mechanisms are mechanical and include multiple rollers and moving parts. Such door locking mechanisms require frequent adjustments and are a cause for many callbacks.

In recent years, elevator codes have required locking devices for preventing elevator car doors from opening when the elevator car is not within the door zone. Existing door locks for the elevator car doors are similar to locks used for the hoistway doors and are primarily mechanical. The elevator car door locks also require cumbersome installation procedures and frequent adjustments. Additionally, in the event of failure of the door lock, the elevator controller is not aware of failure.

Another major concern in elevator car door locking mechanisms, besides reliability and adjustability problems, is noise level. Noise is a concern since the door locking mechanism should not be noticeable to the occupants of the elevator car. Power consumption of the door lock is another consideration in designing door locks.

DISCLOSURE OF THE INVENTION

It is an object of the present invention to provide an effective door lock mechanism for elevator car doors.

It is another object of the present invention to minimize power requirements for the door lock.

It is a further object of the present invention to integrate the door lock with the elevator system and ensure that in the event of failure of the door lock, the elevator system is shut down.

It is a further object of the present invention that in the event of loss of power to the building to appropriately lock or unlock the elevator car door depending on its position within the hoistway.

It is an additional object of the present invention to minimize the noise generated by the door lock.

According to the present invention, a door lock includes a lock box attached to an elevator car and a bracket attached to an elevator car door, with the lock box having a locking mechanism driven into locked and unlocked positions by a rotary solenoid. A plunger of the locking mechanism is moved downward into the locked position directly by the solenoid to block the path of the bracket. A pair of retaining magnets latch an actuator of the solenoid in either a locked or unlocked position. The retaining magnets eliminate the need for power during either the locked or unlocked state of the door lock.

The door lock also includes a controller for controlling the locked and unlocked states of the door lock, for integrating the door lock with the elevator system, and for monitoring the state of the door lock. Continuous monitoring of the state of the door lock allows immediate detection of door lock failure. Additionally, in the event of loss of power to the building, the door lock controller verifies the position of the elevator car with the elevator controller and depending on the position of the elevator within the hoistway, instructs the door lock to either lock or unlock.

One feature of the present invention is that during inspection of the elevator, a command from the elevator controller to the elevator car door lock unlocks the door lock and eliminates the need for the mechanic to manually unlock the door lock during inspection.

An advantage of the present invention is a low noise level. The rotary solenoid used in the door lock of the present invention results in a minimal noise level. Retaining magnets also contribute to reduction of the noise level.

Another advantage of the present invention is ease of installation.

A further advantage of the present invention is that the door lock can be used with any type of door system.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
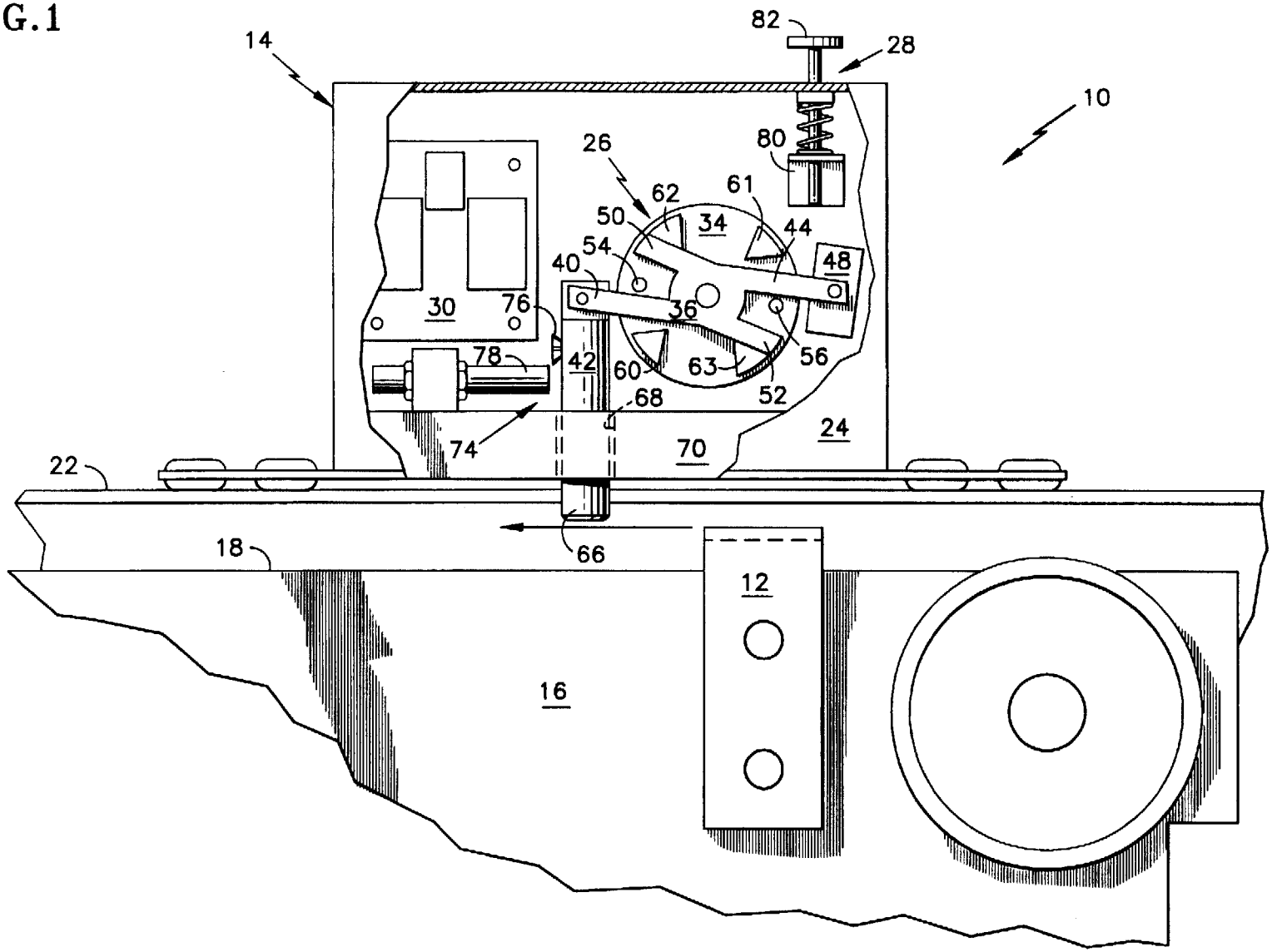
FIG. 1 is a schematic, side elevation of an elevator door lock in an unlocked position, according to the present invention.

Referring to FIG. 1, an elevator car door lock 10 includes a bracket 12 and a lock box 14. The bracket 12 is fixedly attached to an elevator car door 16 and extends above a top edge 18 of the elevator car door 16. The lock box 14 is fixedly attached onto an elevator car 22 and comprises a housing 24 with a locking mechanism 26, manual release mechanism 28, and a circuit board 30.

The locking mechanism 26 includes a rotary solenoid 34 with a solenoid actuator 36. The actuator 36 includes a plunger arm 40 attaching to a plunger 42 and a counterweight arm 44, disposed opposite from the plunger arm 40, attaching to a counterweight 48. The actuator 36 also includes a first magnet member 50 and a second magnet member 52, each spaced apart from the plunger arm 40 and counterweight arm 44, respectively. A first retaining magnet 54 is located on the solenoid 34 between the first magnet member 50 and the plunger arm 40. A second retaining magnet 56 is disposed on the solenoid 34 between the second magnet member 52 and the counterweight arm 44. A plurality of stops 60–63 is disposed on the solenoid 34, with each stop 60–63 being adjacent to the plunger arm 40, counterweight arm 44, the first and second magnet members 50, 52, respectively.

The plunger 42 includes a free end 66 that is guided through an opening 68 within a guide block 70.

A feedback mechanism 74 includes a position indicator 76 which is mounted on the plunger 42 facing a feedback sensor 78.

The manual release mechanism 28, secured within the housing 24, includes a spring loaded lever 80 and a push button 82.

Figure 3:
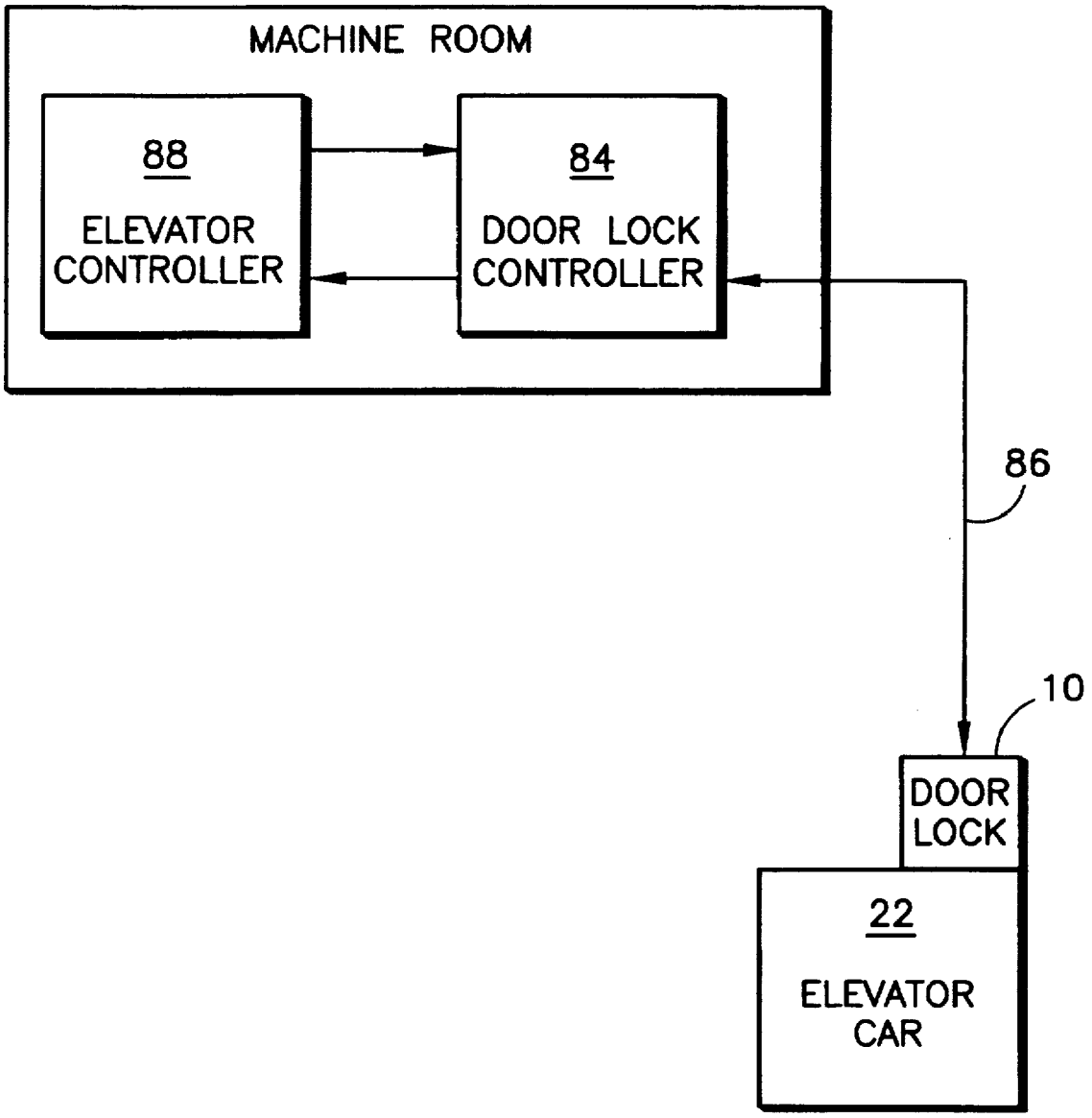
FIG. 3 is a schematic block diagram of communication between the elevator door lock of FIG. 2 and an elevator controller.

Referring to FIG. 3, the door lock circuit board 30, mounted within the housing 24, is connected to the rotary solenoid 34 and the feedback sensor 78. The door lock circuit board 30 communicates with a microprocessor-based car door lock controller 84 disposed in a machine room of the elevator system via a travelling cable 86. The door lock controller 84 also communicates with an elevator controller 88 disposed in the machine room.

Figure 2:
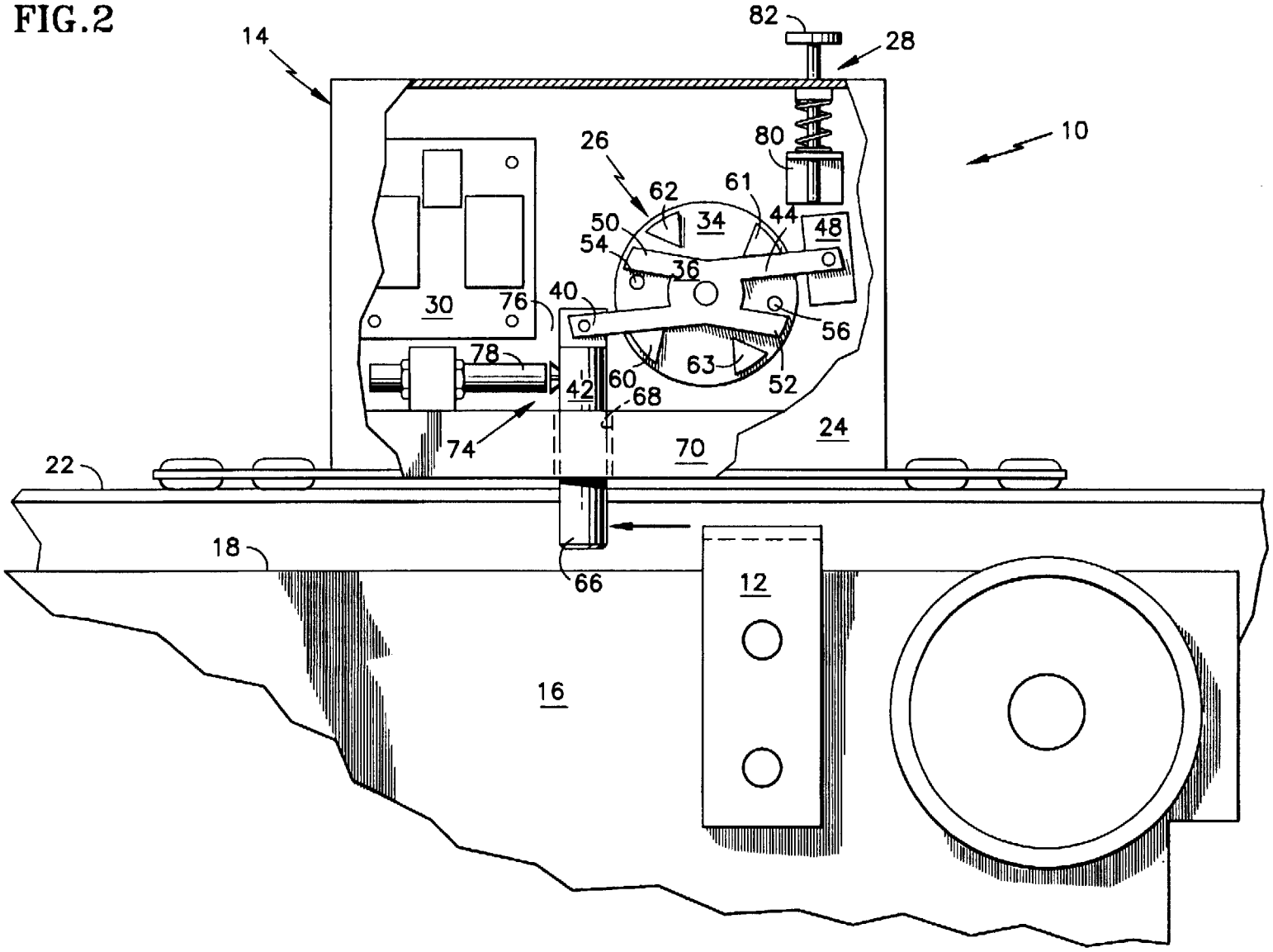
FIG. 2 is a schematic, side elevation of the elevator door lock of FIG. 1 in the locked position.

In operation, the elevator car door lock 10 has an unlocked state and a locked state, as shown in FIGS. 1 and 2, respectively. When the elevator car is within the door zone, the elevator car door lock 10 is in the unlocked state. In the unlocked state, the plunger 42 is lifted upward not to interfere with door opening and closing operations. In the upward position, the plunger 42 allows sufficient clearance between the free end 66 of the plunger 42 and the bracket 12 to ensure uninhibited opening and closing of the door 16.

The counterweight 48, having approximately the same weight as the plunger 42, balances the weight of the plunger and reduces the likelihood of accidental locking and unlocking. The magnets 54, 56 magnetically retain the actuator 36 in the unlocked position. In the unlocked position, the plunger arm 40 and the counterweight arm 44 are in close proximity to the magnets 54, 56. However, the stops 62, 63 ensure that contact between the magnets 54, 56 and the plunger arm 40 and counterweight arm 44 is not made. The feedback mechanism 74 confirms that the plunger 42 is in the upward position when the sensor 78 does not detect the position indicator 76. The feedback mechanism 74 sends a signal to the door lock circuit board 30 that the doors can open and close freely. The status of the door lock is then communicated to the door lock controller 84 via the travelling cable 86. In the unlocked position the solenoid 34 does not require power.

As the door lock controller 84 receives a signal from the elevator controller 88 that the elevator car has left the door zone, the rotary solenoid 34 is powered momentarily. The door lock controller 84 sends a pulse via the travelling cable 86 to the solenoid. The solenoid rotates counterclockwise for a preset amount lowering the plunger 42 into the locked position. The plunger is guided vertically by the guide block 70. The magnets 54, 56 magnetically latch the first and second magnet members 50, 52 in the locked position. The stops 60, 61 ensure that the actuator 36 does not rotate any further and that the magnets 54, 56 and magnet members 50, 52 do not come into contact. The feedback mechanism 74 confirms that the plunger 42 is in the locked position when the position indicator 76 moves into the reading zone of the sensor 78. The locked status of the door lock 10 is then communicated to the elevator controller 88 through the door lock controller 84 and the door lock circuit board 30.

In the event of an emergency, in which the elevator shuts down outside the unlocking zone with the door lock 10 in the locked position and the elevator car doors 16 must be opened, an authorized elevator mechanic can unlock the elevator car doors by pressing down the push button 82 of the manual release mechanism 28. The manual release mechanism 28 engages the counterweight 48 by pushing it downward, and thereby moving the plunger 42 upward into the unlocked position. The feedback mechanism 74 communicates the status of the door lock.

One feature of the present invention is that during inspection of the elevators, a command from the elevator controller 88 to the door lock controller 84 causes the door to unlock. This eliminates any need for the mechanic to manually unlock the door during inspection.

Another feature of the present invention is failure management. The feedback mechanism 74 of the elevator car door lock of the present invention continuously monitors the state of the lock and communicates the state of the lock to the elevator controller 88 via the door lock controller 84. In the event that the state of the elevator car door lock is different from its assumed state, the elevator will be shut down.

An additional feature of the present invention is that in the event of power loss to the building, the door lock is either locked or unlocked subsequent to such power failure, based on the location of the elevator car within the hoistway. Once the door lock controller 84 detects a power failure through diagnostics, it also determines the position of the elevator within the hoistway and determines in what state the door lock should be. The door controller then proceeds to move the door controller into the appropriate position. The door controller board includes a plurality of capacitors (not shown) to store energy for a sufficient period of time after power failure to perform the above-described procedure. In the best mode of the present invention, the time required to perform the above described procedure is 8 seconds.

One major advantage of the present invention is that the rotary solenoid 34 is a latch type of solenoid and significantly reduces power requirements. The elevator car door lock does not require power in either the locked or unlocked state. The power is required only for changing from one state to another. The power requirement is reduced further by the counterweight 48. This ensures proper operation of the door lock even in the event of a power failure and eliminates the need for backup battery power.

Another advantage of the present invention is minimal noise level during operation. This rotary solenoid 34 is virtually silent. The quietness of the present invention can also be attributed to use of magnets that latch the actuator without mechanical contact. The present invention represents a significant reduction in noise level relative to existing products.

A further advantage of the present invention is ease of installation. The installation of the present invention does not require high precision or accuracy during the installation. The entire locking mechanism is contained within the housing 24 and installed as one piece. The position of the bracket 12 relative to the lock box 14 does not require precise alignment.

An additional advantage of the present invention is that the door lock can be used with any type of a door system.

Many types of rotary solenoids would be applicable for use in this invention. However, in the best mode of the present invention the rotary solenoid used was Lucas Ledex Ultimag 5E manufactured by Lucas Ledex Inc. of Vandalia, Ohio.

While the present invention has been illustrated and described with respect to a particular embodiment thereof, it should be appreciated by those of ordinary skill in the art, that various modifications to this invention may be made without departing from the spirit and scope of the present invention.

We claim:

1. A door lock for locking an elevator car door of an elevator car when said elevator car is outside of a door zone, said door lock comprising:

a lock box fixedly mounted onto said elevator car;

a rotary solenoid mounted within said lock box, said rotary solenoid having an actuator, said actuator moving a plunger into a locked position and an unlocked position; and a bracket fixedly attached onto said elevator car door, in said locked position said plunger engaging said bracket.

2. The door lock according to claim 1 further comprising a counterweight attached to an opposite end of said actuator to balance the weight of said plunger.

3. The door lock according to claim 1 further comprising a guide block, said guide block having an opening for guiding said plunger.

4. The door lock according to claim 1 further comprising a manual release mechanism.

5. The door lock according to claim 1 further comprising a feedback mechanism for monitoring state of said door lock.

6. The door lock according to claim 5 wherein said feedback mechanism includes a position indicator and a sensor with said sensor detecting said position indicator in said locked state.

7. The door lock according to claim 1 wherein said rotary solenoid is a latch-type solenoid.

8. The door lock according to claim 1 further comprising a plurality of retaining magnets.

9. The door lock according to claim 8 wherein said plurality of retaining magnets latches said actuator in said locked position and in said unlocked position.

10. The door lock according to claim 9 wherein said plurality of retaining magnets latches said actuator without mechanical contact.

11. A door locking system having a door lock for locking an elevator car door of an elevator car when said elevator car is outside of a door zone, said door lock comprising:

a lock box fixedly mounted onto said elevator car;

a solenoid mounted within said lock box, said solenoid having a locked position and an unlocked position;

a bracket fixedly attached onto said elevator car door, in said locked position said lock box engaging said bracket; and a door lock controller including instructions for controlling said locked and unlocked positions of said door lock, said controller further including instructions for opening said door lock upon receiving instructions from an elevator controller that said elevator car will undergo inspection.

12. The door locking system according to claim 11, wherein said controller includes instructions for monitoring said locked and unlocked positions of said door lock.

13. The door locking system according to claim 11, wherein said controller includes instructions to change state of said door lock in the event of power failure based on position of said elevator car within a hoistway.

14. The door locking system according to claim 11, wherein said controller includes instructions to shut down said elevator car upon detection of failure of said door lock by said controller.

* * * * *